United States Patent [19]

Hegler et al.

[11] Patent Number: 4,488,467

[45] Date of Patent: Dec. 18, 1984

[54] APPARATUS FOR CUTTING OPENINGS IN PIPES

[75] Inventors: Wilhelm Hegler, Goethestrasse 2, D-8730 Bad Kissingen; Ralph-Peter Hegler, Bad Kissingen, both of Fed. Rep. of Germany

[73] Assignee: Wilhelm Hegler, Bad Kissingen, Fed. Rep. of Germany

[21] Appl. No.: 453,468

[22] Filed: Dec. 27, 1982

[30] Foreign Application Priority Data

Jan. 5, 1982 [DE] Fed. Rep. of Germany ..... 3200081

[51] Int. Cl.[3] ..... B26D 5/08

[52] U.S. Cl. ..... 83/303; 83/54; 83/329; 83/490; 83/647.5

[58] Field of Search ..... 409/183; 83/54, 340, 83/342, 672, 329; 408/35

[56] References Cited

U.S. PATENT DOCUMENTS

| | | | |
|---|---|---|---|
| 3,824,886 | 7/1974 | Hegler | 83/54 |
| 3,916,736 | 11/1975 | Maroschak | 83/54 X |
| 4,000,672 | 1/1977 | Sitterer et al. | 83/54 X |
| 4,218,164 | 8/1980 | Lupke et al. | 83/54 X |
| 4,219,293 | 8/1980 | Licht | 408/35 X |
| 4,270,878 | 6/1981 | Fales | 83/54 X |

*Primary Examiner*—William R. Briggs
*Assistant Examiner*—Lawrence H. Meier
*Attorney, Agent, or Firm*—Laff, Whitesel, Conte & Saret

[57] ABSTRACT

An apparatus for cutting openings in pipes of cuttable material, in particular in plastics drainage pipes has at least one cutter head carrying at least one cutter, the cutter head rolling at least in part on the periphery of the pipe and being positively driven for this by means of a planetary gear. By virtue of this, the cutting edge of the cutter moves around the pipe in an epitrochoid. The cutter head is provided with ridges engaging in transverse corrugations in the outer wall of the pipe.

In order to be also able to cut openings in pipes formed at least in part with annular corrugations over their periphery, at least the cutter head is provided with helically extending ridges and the at least one cutter is disposed parallel to these ridges.

7 Claims, 10 Drawing Figures

Fig. 3
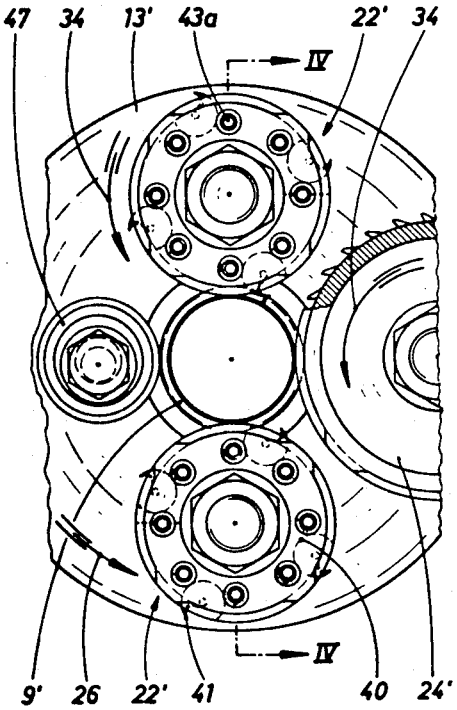
Fig. 4
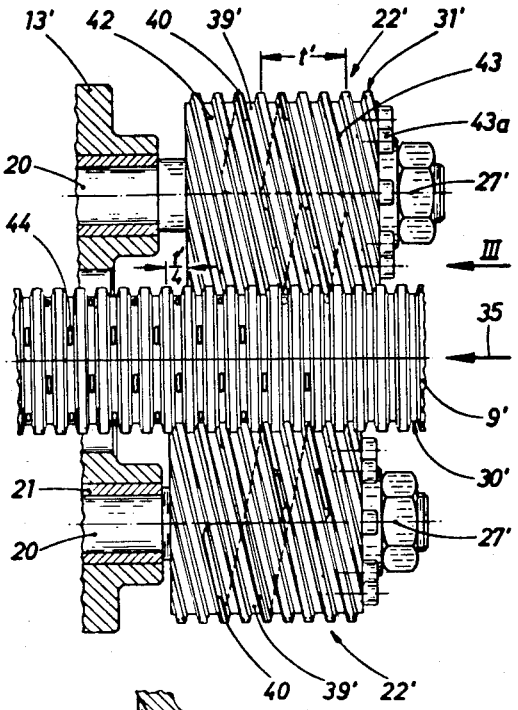
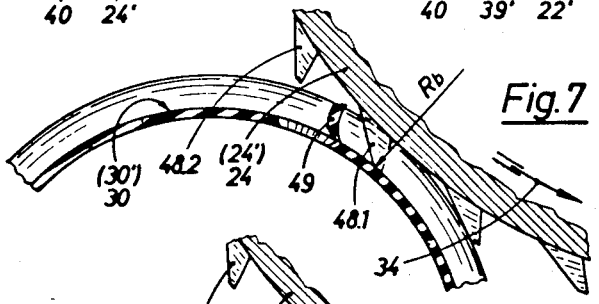
Fig. 7
Fig. 10
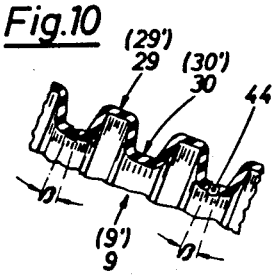
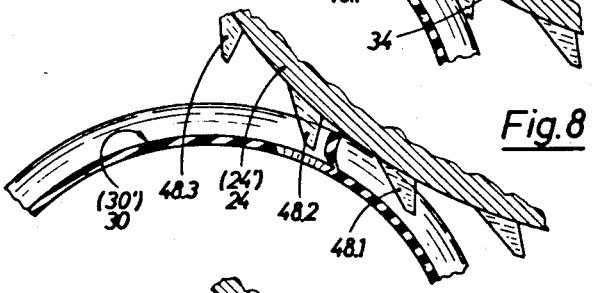
Fig. 8
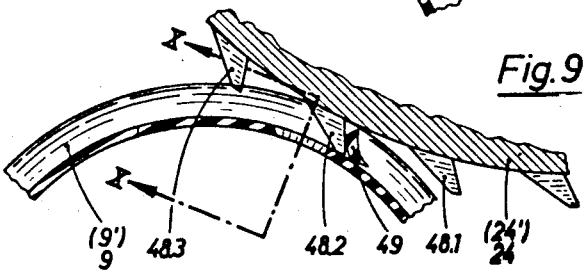
Fig. 9

APPARATUS FOR CUTTING OPENINGS IN PIPES

BACKGROUND OF THE INVENTION

1. Field of the Invention

This invention relates to apparatus for cutting openings in the wall of a pipe of cuttable material, in particular plastics drainage pipes, the outer periphery of the wall of the pipe having transverse corrugations.

2. Description of the Prior Art

A known apparatus of this kind comprises at least one cutter head having ridges for engaging in the transverse corrugations of the pipe, at least one cutter mounted on the cutter head, planetary gear means for positively driving the cutter head so that it rolls at least in part on the outer periphery of the pipe and the cutting edge of the cutter moves around the pipe on an epitrochoidal path, at least one support roller for abutting the pipe wall to take up thrust forces and mounting means for the support roller.

Apparatus of this kind known from U.S. Pat. No. 3,824,886 has in practice proved to be very effective, since it makes possible continuous cutting of openings in corrugated pipes and even the cutting of openings in each corrugation valley, the chip cut-out from the outer wall of the pipe being cut out towards the exterior on account of the travel of the cutting edge of each cutter on an epitrochoid and not therefore falling into the pipe. The known apparatus is however deserving of improvement in regard to its use for special forms of pipes, such as for example, pipes having annular corrugations, which in addition can have a foot not to be provided with openings.

BRIEF SUMMARY OF THE INVENTION

It is an object of the invention therefore, to improve the known apparatus of this kind so that pipes having annular corrugations can also be provided with openings in each corrugation valley.

According to the invention, there is provided apparatus for cutting openings in the wall of a pipe of cuttable material, the outer periphery of the wall of the pipe being at least in part annularly corrugated, comprising:

(a) at least one cutter head having helically extending ridges for engaging in the annular corrugations of the pipe;

(b) at least one cutter mounted on the cutter head parallel to the helically extending ridges;

(c) planetary gear means for positively driving the cutter head so that it rolls at least in part on the outer periphery of the pipe and the cutting edge of the cutter moves around the pipe on an epitrochoidal path:

(d) at least one support roller for abutting the pipe wall to take up thrust forces; and (e) mounting means for the support roller.

By means of the construction according to the invention, it is brought about that the pipe is transported in its longitudinal direction at least by the cutter head, even though the transverse corrugations are each formed as annuli or part annuli.

If the pipes are provided with a foot, i.e. therefore, with a portion which is not in form of a circle—which is found relatively often, in particular in the case of drainage pipes—then trouble-free transport may be achieved in spite of the friction forces acting in the slide bed and the cutting of openings in the foot region avoided by the support roller also serving as a transport head and having helically extending ridges for engaging in the annular corrugations of the pipe and the planetary gear means being adapted to positively drive the support roller also, the cutter head and the support roller each having a cut-away region, the boundary of which is defined by at least the surface which would be generated by rolling of the cutter head or support roller respectively on the outer periphery of the pipe, and the cutter head having no cutter(s) on this boundary surface.

Furthermore, in the case of pipes having completely annular corrugations or also in the case of pipes which are only partly annularly corrugated and are provided with a foot, the chips cut out by the respective cutter head or cutter heads can be completely cut off—in so far as this is necessary—by means of a shaving head, which at the same time also contributes to the transport of the pipe. By these arrangements, the tool-life of the cutter is quite considerably increased, even up to ten times its usual life. By adapting the planetary gear means to drive the shaving head at the same speed of revolution as the cutter head and the diameter of the shaving head being an integral multiple of the diameter of the cutter head, it is assured that on the one hand, the slippage between shaving head and pipe occurs during the rolling of the shaving head, but that on the other hand the feeding effect of the shaving head is identical with the feeding effect of the cutter head or heads and optionally with that of the transport head or heads.

BRIEF DESCRIPTION OF THE DRAWINGS

Further advantages and features of the invention will become apparent from the following description of embodiments of the invention, having regard to the drawings.

FIG. 3 shows in part elevation a second embodiment of the invention in the direction of the arrow III of FIG. 4;

FIG. 4 is a part section through the apparatus on the section line IV—IV of FIG. 3;

FIGS. 7 to 9 show the removal of an incompletely cut-off chip by a shaving head, at different phases of its rotation: and FIG. 10 is a section through FIG. 9 on the section line X—X.

DETAILED DESCRIPTION

Figure 2:
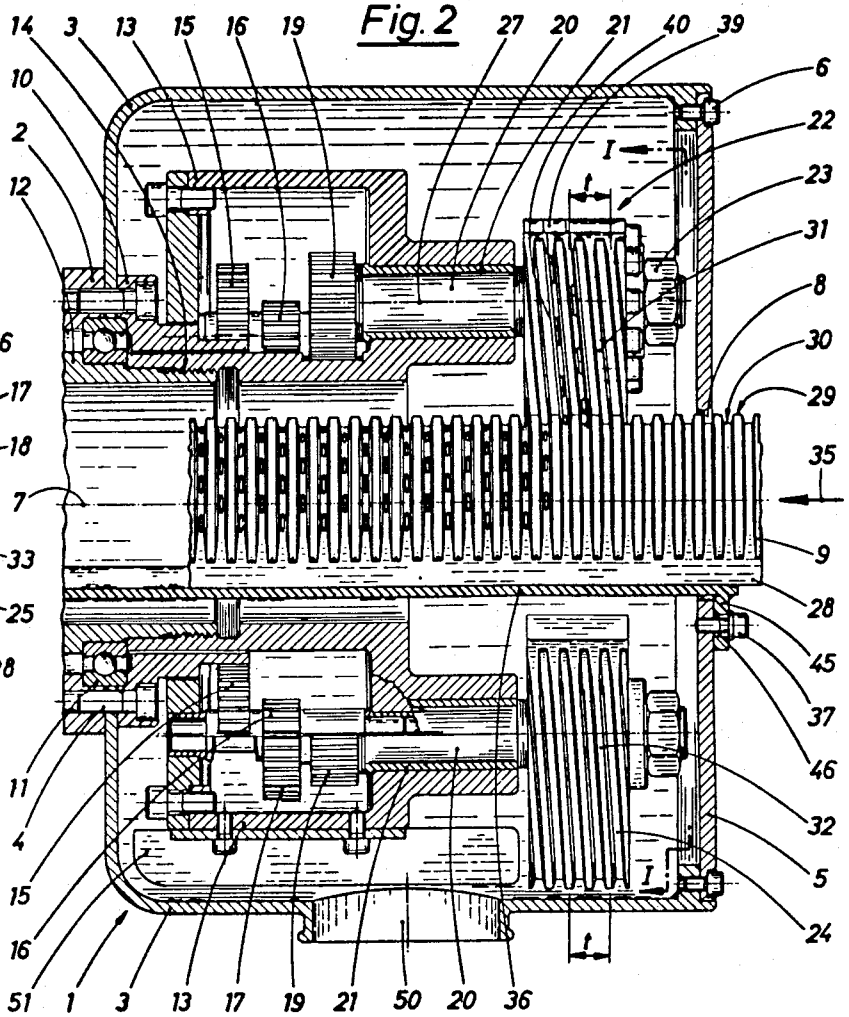
FIG. 2 is a section through the apparatus on the section line II—II of FIG. 1.
Figure 1:
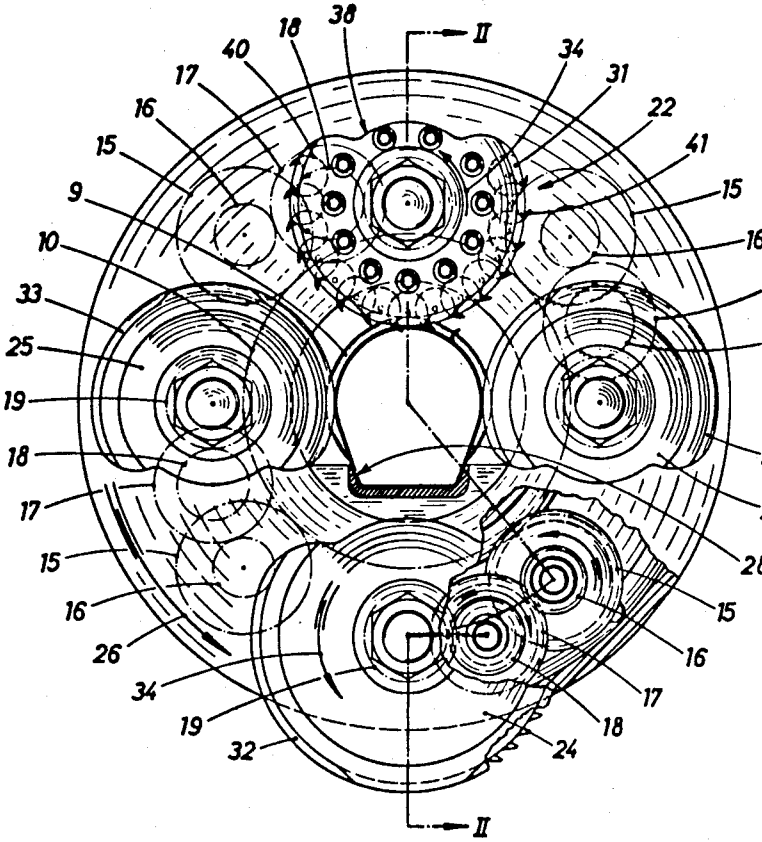
FIG. 1 shows in front elevation apparatus according to the invention on the section line I—I of FIG. 2.

In the apparatus shown in FIGS. 1 and 2, a fixed, i.e. non-rotatable, housing 1 is provided, which has a hollow boss 2, and a protective shroud 3 is secured to the hollow boss by means of bolts 4. The cup-shaped protective shroud 3 is closed by means of a cover 5 at the end of the cage directed away from the hollow boss 2, and the cover is bolted onto the protective shroud 3 by bolts 6. The cover 5 has an inlet opening 8 for a pipe 9 to be explained further hereinafter, the opening being concentric with the central longitudinal axis 7 of the housing 1.

A stationary outer ring-gear is connected to the housing 1 by means of the bolts 4, so that the sun-wheel 10 of a planetary gear is in question. A hollow shaft 12 is rotatably mounted in the housing 1 by means of a ball bearing 11, and a drive flange 13 is screwed onto the shaft, for rotation with it, by means of a screw thread 14. The inner diameter of the hollow shaft 12, which is disposed concentrically with the axis 7, is however substantially greater than the outer diameter of the pipe 9 to be introduced through the hollow shaft 12.

Pairs of planet wheels 15, 16 and 17, 18 respectively, are rotatably mounted in the shroud-form drive flange 13. The planet wheels 15, 16 are disposed concentrically with one another and are connected fixedly to each other, i.e. they are connected for rotation together by means of a common shaft, the planet wheel 15 engaging in the sun wheel 10. The two planet wheels 17, 18 are also disposed coaxially with one another and fixedly connected to each other, i.e. they are likewise connected for rotation together by means of a common shaft. The planet wheel 16 engages in the planet wheel 17, so that the planet wheel 18 is also driven. The planet wheel 18 engages in a drive gear 19, which is in turn mounted on a shaft 20 for rotation with the shaft, the shaft 20 being rotatably mounted in a bearing 21 in the drive flange 13. At the other end of the shaft 20, i.e. on the other side of the bearing 21, a three-part cutter head 22 is secured on the shaft 20 by means of a threaded nut 23. Further pairs of planet wheels 15, 16 and 17, 18 are rotatably mounted in the drive flange 13 and serve for the drive of a shaving head 24 and for the drive of transport heads 25 respectively. The shaving head 24 and the transport heads 25 are secured on shafts 20 by means of threaded nuts 23, in the same manner as the cutter head 22, and approximately in a plane which is the same as that of the cutter head and is perpendicular to the axis 7. The shafts 20 are mounted in bearings 21 in the drive flange 13 and carry a drive gear 19, which engages in the adjacent planet wheel 18. The sun wheel 10, the planet wheels 15 to 18 and the drive gears 19 are laid out in a manner known for planetary gearing, so that for a full revolution of the drive flange 13 in the direction of the arrow 26, the shafts 20 and with them the cutter head 22, the shaving head 24 and the transport heads 25 each undergo exactly one revolution about their own axis 27.

In the case of the pipe 9, a so-called circularly corrugated pipe having a foot 28 is in question, i.e. the pipe 9, which has a circular cross-section over the greater part of its periphery, has part-annular corrugation peaks 29 and corrugation valleys 30, each lying in planes perpendicular to the axis 7. The cutter head 22, and likewise the shaving head 24 and the transport heads 25, are each provided with a helical profile, the ridges 31, 32 and 33 of which engage in the corrugation valleys 30. In the present case, the cutter head 22, the shaving head 24 and the transport heads 25 are provided with ridges 31, 32 and 33 is the manner of a two-start screw thread, the pitch t of which therefore extends in each case over the axial extent of two ridges 31, 32 and 33. The pitch t of the cutter head 22, the shaving head 24 and the transport heads 25 is identical and is equal to the axial spacing of each of the corrugation peaks 29 of the pipe 9 from the next corrugation peak but one. Since for each full revolution of the drive flange 13, the cutter head 22, the shaving head 24 and the transport heads 25 each rotate once relative to the drive flange 13 about their own axis 27 in the direction of rotation 34, for each revolution of the drive flange 13 the pipe 9 is advanced in the transport direction 35 by the amount of the pitch t, and therefore by twice the spacing of two neighbouring corrugation peaks 29.

A slide bed 36 matching the shape of the foot 28 of the pipe 9 is disposed in the hollow shaft 12. The slide bed passes through the inlet opening 8 in the cover 5 and is secured to the cover by means of bolting-up 37.

In order that cutter head 22, shaving head 24 and transport heads 25 do not come into collision with the slide bed 36 in the course of their travel around the pipe 9, a region of each head 22, 24 and 25 is cut away, each head having an otherwise circular cross-section. The boundary line 38 of the cut-away region corresponds at least to the curve which would be generated by the rolling drive of each head 22, 24 and 25 past and against the slide bed 36. Obviously a still greater portion can be cut away, for example by a straight boundary line.

Since in the embodiment according to FIGS. 1 and 2, at least four heads 22, 24 and 25 are provided, each of the heads being provided with a positive drive, two or three of them are always in engagement with the pipe 9, so that in spite of the friction of the foot of the pipe 9 in the slide bed 36, a troublefree feed of the pipe 9 is assured.

The cutter head 22 is formed in three parts. It has a central cutter carrier 39, on which cutters 40 are mounted, the cutters having cutting edges 41 leading in the direction of rotation 34 and projecting outwardly over the ridges 31. On both sides of this central cutter carrier 39, considered in the axial direction, sections 42 and 43 are formed, these sections having ridges only. The cutter carrier 39, the two ridge sections 42 and 43 and the cutters 40 are held together by means of locking screws 43*a*.

The cutters 40 and the basic construction of the cutter head 22 are known from German patent specification No. 22 30 767. By means of the cutters 40, water-inlet openings 44 are cut in the pipe 9 in a manner which is known in principle, the openings being cut in each case in the region of the corrugation valleys 30. Since the ridge 31 of the cutter head 22 is formed in the manner of a two-start screw thread, the cutter carrier 39 therefore also extends over two threads, corresponding to the pitch t, and the cutters 40 can be arranged—as can be seen from FIG. 2—so that the openings 44 in two mutually adjacent corrugation valleys 30 are not disposed on a line parallel to the axis, but are disposed so that they are staggered with respect to each other.

In order that the rotatable heads 22, 24 and 25, the ridges 31, 32 and 33 of which are in engagement with the pipe 9, may rest against the pipe 9 with a light bias, the slide bed 36 is adjustable transverse to its longitudinal direction. For this purpose, elongate holes 46 are provided in a flange 45 penetrated by the screws 37.

The embodiment according to FIGS. 3 and 4 differs from that of FIGS. 1 and 2 principally in that two cutter heads 22' are provided, these being disposed diametrically opposite one another. The mounting and the drive correspond with those of FIGS. 1 and 2. The arrangement of two cutter heads 22' is possible because a normal circularly corrugated pipe 9' is being furnished with openings 44; there is therefore no foot on the pipe 9'. For this reason there is also no slide bed provided. A shaving head 24 is provided, which likewise has no recess. Since no slide bed is provided, neither do any transport heads effecting an axial feed of the pipe 9' need to be provided. For taking up the thrust forces, there needs to be provided only at least one support roller 47, which is not driven, but is mounted to be freely rotatable in the drive flange 13'. The cutter heads 22' are formed with four starts and therefore have four ridges 31'. For one revolution of each cutter head 22', the pipe 9' is therefore advanced in the direction of transport 35 by the axial spacing of four ridges 31', which corresponds to the pitch t'. Both cutter heads 22' are formed identically and are therefore interchangeable with each other. Since in the construction according to FIG. 4, the cutters 40 are not staggered, in contrast to the construction of FIG. 2, the cutters 40 must therefore be mounted parallel to one another in the cutter heads 22' at a spacing of t'/2. The upper cutter head 22' cuts in this way the openings 44 in each of the second and fourth corrugation valleys 30', while the lower cutter head 22', which is disposed at a displacement in the axial direction of t'/4 relative to the upper head, cuts the openings 44 in the first and third corrugation valleys 30'. By a rotational displacement of one of the cutter heads 22' through one-half of the cutter spacing, there results the staggered arrangement of the openings 44' from the first to the second corrugation valley 30' and from the third to the fourth corrugation valley 30'. This embodiment and arrangement of the cutter heads 22' enables transport of the pipe 9' at a speed which is doubled by comparison with the embodiment according to FIGS. 1 and 2. This comes in question in particular for pipes 9' of smaller diameter.

Figure 5:
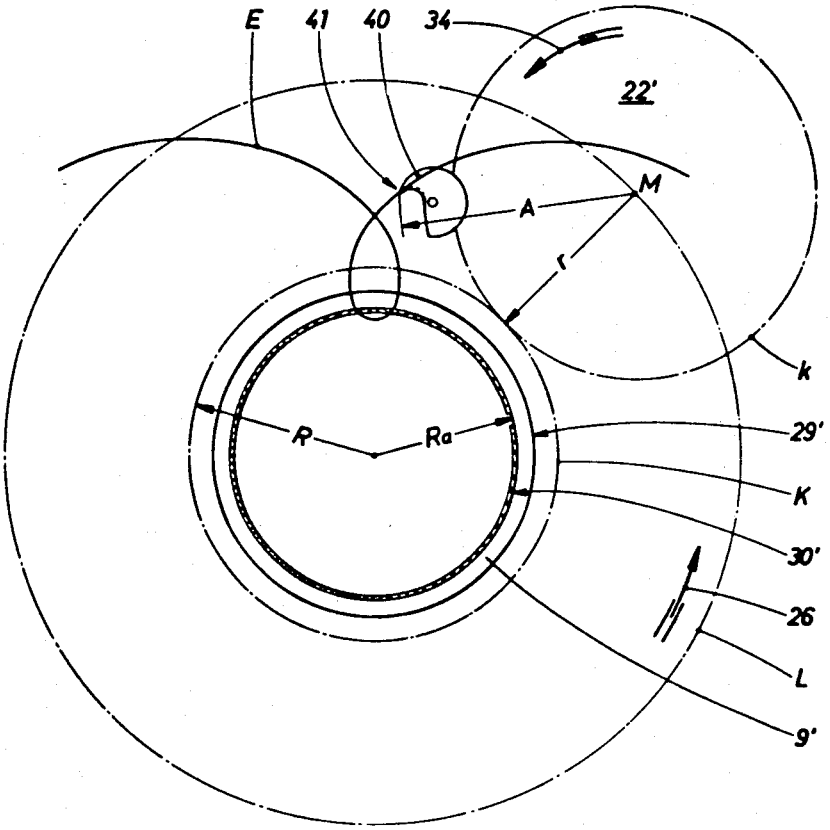
FIG. 5 is a schematic representation of the rolling movement of the cutter head on the pipe.
Figure 6:
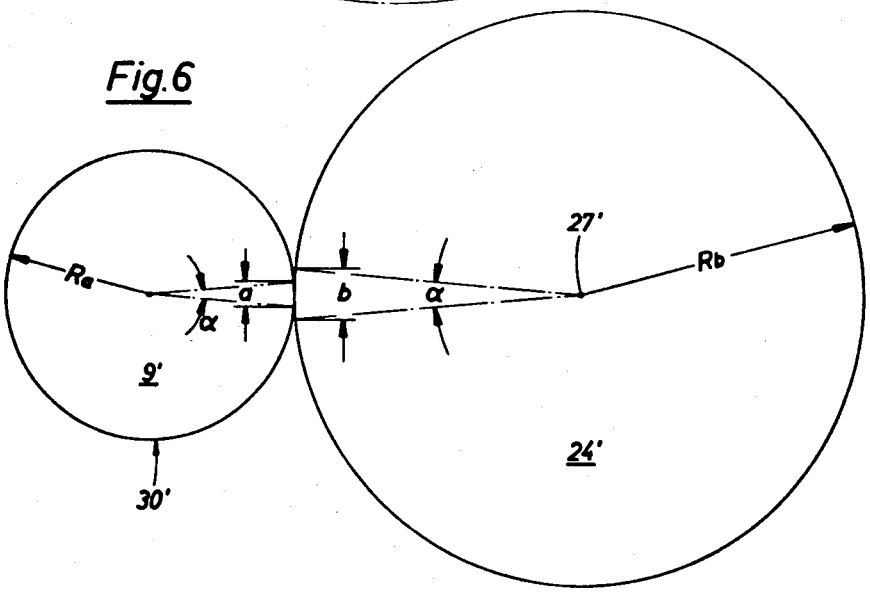
FIG. 6 is a schematic representation of the rolling movement of the shaving head on the pipe.

The manner of working of the cutter heads, which is known in principle, will be explained having regard to FIG. 5, in which for simplicity, a pipe 9' having a circular cross-section is being furnished with openings. In general the same reference numerals are used as in FIGS. 1 to 4, in so far as these can be used here. As follows from FIG. 5, on the basis of the kinematic arrangements depicted, the cutting edge 41 of a cutter 40 of one of the cutter heads 22' or 22 moves on an epitrochoid E. The epitrochoid E is the curve which—as shown in FIG. 5—is described by a point, namely the cutting edge 41 of the cutter 40, when a rolling circle k of radius r rolls without slipping on a guide circle K of guide-circle radius R and the spacing A of the point (cutting edge 41) from the centre M of the rolling circle is greater than the radius r of this rolling circle k. During the rolling movement the centre M of the rolling circle k moves on a circular line L. As FIG. 5 shows, the epitrochoid E forms a loop which dips inside the guide circle K. In the technical realisation, the rolling circle k is formed by the cutter head 22' or 22, while the guide circle K is formed by the pipe 9' or 9. Each time the cutting edge 41 dips inside the guide circle K, i.e. into the pipe 9' or 9, an opening is cut in the pipe 9' or 9, the cutter cutting a piece out of the wall of the pipe 9' or 9 each time it traverses the small loop and moreover, the direction of cutting being directed radially outwards at the end of the cut, so that the cut-out chip falls outwardly.

The construction and functioning of the shaving heads 24 and 24' will be apparent from FIGS. 6 to 10. The circularly corrugated pipe 9' has a corrugation valley (30') radius Ra, while the value assigned to the radius Rb of the shaving head 24' (or 24) is $Rb=2\times Ra$. Since for a revolution of the drive flange 13 or 13', the shaving head 24 or 24' is constrained to make a complete revolution relative to the drive flange about the axis 27 or 27' of the shaving head, the shaving head has at its periphery a slippage of 50% with respect to the corrugation valley 30' of the pipe 9', because the rolling angle $\alpha$ in the case of the pipe 9' on the one hand and in the case of the shaving head 24' or 24 on the other hand are the same. When therefore the shaving head 24' or 24 has advanced by a shaving length a corresponding to the rolling angle $\alpha$ referred to the pipe 9', then the periphery of the shaving head has advanced by the effective length b, b being equal to $2\times a$.

As shown in FIGS. 7 to 9, the periphery of the shaving head 24 or 24' is provided with cutting teeth 48.1, 48.2, 48.3 . . . , the outer radius of which is the same as Rb. As shown in FIG. 7, the chip 49 to be cut out in the cutting of an opening 44 is not completely cut off—for example on account of the cutting edge 41 of a cutter 40 becoming blunt. As can be seen from FIG. 7, one cutting tooth 48.1 has already passed by the chip 49 and the next cutting tooth 48.2 is approaching in the direction of the chip 49. As shown in FIG. 8, the following cutting tooth 48.2 overtakes the chip 49 and as shown in FIG. 9 cuts it off. The chip falls into the protective shroud 3, where it is withdrawn through a lower outlet opening 50 together with the other chips. A guide plate 51 is secured to the drive flange 13 for facilitating this outward movement of the chips, the cut-off chips 49 being pushed to the outlet opening 50 by means of the guide plate.

As can be seen from FIG. 10, the openings 44 widen out towards the interior of the pipe 9 or 9' by an angle $\beta$. This widening is very advantageous, in particular for drainage purposes. The reason for the widening is that the cutting-out of the openings 44 takes place by a chip 49 being cut out in each case substantially outwardly from the inside. As a result, the pipe is slightly bowed towards the exterior in the region of a corrugation valley 30 or 30' whereby the plastics material of the pipe receives a slightly conical area of cut having an angle of cut $\beta$, the area of cut tapering inwardly towards the exterior and widening towards the interior.

The pipes 9 and 9' are manufactured from plastics in corrugated pipeforming machines of known kind upstream of the present apparatus.

It should also be added that the axes 27 and 27' of the respective cutter heads 22, 22', the shaving heads 24, 24' and the transport heads 25, are shown in the drawings as parallel to the axis 7 of the pipe 9 or 9' only for the purposes of simplifying the drawings. In fact these axes must be disposed with respect to the axis 7 in accordance with the lead angle of the ridges 31 or 31', 32 and 33 resulting from the pitch t. This is achieved by the last planet wheel 18 in each case and its associated drive gear 19 being formed as bevel gears with corresponding bevel angles. This arrangement is however known and is necessarily likewise used in practice in the apparatus known from German patent specification No. 22 30 767.

We claim:

1. Apparatus for cutting openings in the was of a pipe of cuttable material, the outer periphery of the wall of the pipe being at least in part annularly corrugated, comprising:

(a) at least one cutter head having helically extending ridges for engaging in the annular corrugations of the pipe;

(b) at least one cutter mounted on the cutter head parallel to the helically extending ridges;

(c) planetary gear means for positively driving the cutter head so that it rolls at least in part on the outer periphery of the pipe and the cutter edge of the cutter moves around the pipe on an epitrochoidal path;

(d) at least one support rollwe for abutting the pipe wall to take up thrust forces;

(e) mounting means for support roller;

(f) a shaving head for severing a chip previously cut by the cutter having helically extending ridges for engaging in the annular corrugations of the pipe; with the planetary gear means being adapted to positively drive the shaving head with slippage relative to the pipe.

2. Apparatus according to claim 1, wherein the planetary gear means is adapted to drive the shaving head at the same speed of revolution as the cutter head and the diameter of the shaving head is an integral multiple of the diameter of the cutter head.

3. Apparatus according to claim 1 for cutting openings in the wall of a plastics drainage pipe.

4. Apparatus for cutting openings in an annularly corrugated part of the wall of a pipe of cuttable material, the pipe having a non-corrugated foot and the remainder of the outer periphery of the wall of the pipe being at least in part annularly corrugated, comprising:

(a) at least one cutter head having helically extending ridges for engaging in the annular corrugations of the pipe;

(b) at least one cutter mounted on the cutter head parallel to the helically extending ridges;

(c) at least one support roller for abutting the pipe wall to take up thrust forces, the support roller also serving as a transport head and having helically extending ridges for engaging in the annular corrugations of the pipe; and (d) planetary gear means for positively driving the cutter head and the support roller so that the cutter head rolls at least in part on the outer periphery of the pipe and the cutting edge of the cutter moves around the pipe on an epitrochoidal path; the cutter head and the support roller each having a cut-away region, the boundary of which is defined by at least the surface which would be generated by rolling of the cutter head or support roller respectively on the section of the outer periphery of the pipe which defines the non-corrugated foot, the cutter head having no cutter(s) on this boundary surface so that the planetary rotation of the cutter head and support roller about the periphery of the pipe occurs without contact between the non-corrugated foot and the cut-away regions of the cutter head and support roller.

5. Apparatus according to claim 4, further comprising:

a shaving head having helically extending ridges for engaging in the annular corrugations of the pipe;

the planetary gear means being adapted to positively drive the shaving head with slippage relative to the pipe.

6. Appparatus according to claim 5, wherein the planetary gear means is adapted to drive the shaving head at the same speed of revolution as the cutter head and the diameter of the shaving head is an integral multiple of the diameter of the cutter head.

7. Apparatus according to claim 4 for cutting openings in the wall of a plastics drainage pipe.

* * * * *